US009296599B2

(12) United States Patent
Forestelli et al.

(10) Patent No.: US 9,296,599 B2
(45) Date of Patent: Mar. 29, 2016

(54) SAMPLING CONTROL STATION FOR BOTTLES OR CONTAINERS FILLING PLANT

(75) Inventors: Fabio Forestelli, Alseno (IT); Alberto Cirio, Canelli (IT)

(73) Assignees: FT SYSTEM S.R.L., Alseno (PC) (IT); AROL S.P.A., Canelli (AT) (IT)

( * ) Notice: Subject to any disclaimer, the term of this patent is extended or adjusted under 35 U.S.C. 154(b) by 720 days.

(21) Appl. No.: 13/395,858

(22) PCT Filed: Sep. 8, 2010

(86) PCT No.: PCT/IB2010/002256

§ 371 (c)(1),
(2), (4) Date: May 23, 2012

(87) PCT Pub. No.: WO2011/030209

PCT Pub. Date: Mar. 17, 2011

(65) Prior Publication Data

US 2012/0240519 A1 Sep. 27, 2012

(30) Foreign Application Priority Data

Sep. 14, 2009 (IT) ..... MI2009A1572

(51) Int. Cl.
*B67B 3/26* (2006.01)
*B67B 3/20* (2006.01)

(52) U.S. Cl.
CPC ..... *B67B 3/261* (2013.01)

(58) Field of Classification Search
CPC ..... B67B 3/26; B67B 3/2013; B67B 3/206
USPC ..... 53/484, 485, 109
See application file for complete search history.

(56) References Cited

U.S. PATENT DOCUMENTS 4,691,496 A * 9/1987 Anderson et al. ..... 53/53
2005/0284103 A1* 12/2005 Hartness et al. ..... 53/136.1
2009/0293437 A1* 12/2009 Schulz et al. ..... 53/490

FOREIGN PATENT DOCUMENTS

DE 102006062536 A1 7/2008
EP 0328249 A1 8/1989
EP 1132331 A1 9/2001
EP 1249426 A1 10/2002
WO WO 2007137737 A1 * 12/2007

OTHER PUBLICATIONS

International Search Report Dated January 24, 2011.

* cited by examiner

*Primary Examiner* — Andrew M Tecco
*Assistant Examiner* — Praachi M Pathak
(74) *Attorney, Agent, or Firm* — Hedman & Costigan, P.C.; James V. Costigan; Kathleen A. Costigan

(57) ABSTRACT

The present invention refers to a sampling control station for a containers or bottles filling plant and to a containers or bottles filling plant comprising the same.
The sampling control station according to the present invention comprises at least one grasping and transporting group (22) for picking up containers or bottles (16) from conveying means (18) and transporting them to a measuring zone, and at least one module (40) for measuring the removal torque and/or the reclosing angle of a cap (28) of the container (16) acting upon a container or bottle (16) transported to the measuring zone, and it is characterized in that the module (40) for measuring the removal torque and the reclosing angle is such as to take up a first configuration engaged with the cap (28), wherein the cap (28) can be set in rotation by the module (40) for measuring the removal torque and the reclosing angle, and a second configuration disengaged from the cap (28).

13 Claims, 5 Drawing Sheets

SAMPLING CONTROL STATION FOR BOTTLES OR CONTAINERS FILLING PLANT

The present invention refers to a sampling control station for a containers or bottles filling plant and to a containers or bottles filling plant comprising the same.

Conventional filling lines of bottles or containers made from plastic, like for example PET, HDPE, PE and so on, containing any kind of liquid, are generally made up of a bottles or containers filling station, followed by a closing and/or capping station of the bottles or containers, as well as by one or more control stations arranged downstream of the closing station.

The filling and closing stations in turn comprise a plurality, respectively, of taps or filling valves and of closing and/or capping heads of the mechanical or electronic type depending on the particular embodiment of the plant.

The filling and closing/capping stations are initially calibrated or set electronically so as to obtain the desired result in output in terms of filling and closing, depending on the particular container that it is wished to treat.

The actual obtaining of the set filling and closing parameters is then monitored by the possible control stations arranged downstream, through which it is possible to inspect the filled bottles or containers, determining whether they do or do not have the filling and closing characteristics that are wished to be obtained.

In particular, according to the specific implementation of the filling line, the control stations make it possible to verify the fill level, the position of a possible cap with respect to the bottle or the container, the tension of the container in response to a pressure exerted and so on.

In addition to the online control, it is necessary—in particular for quality standard requirements—to carry out sampling control of the containers that have passed the line control.

Currently, sampling control generally takes measurement of the removal or unscrewing torque and of the reclosing angle, a measurement of the weight of the filled and sealed container, a measurement of the gas content and/or pressure of such a container and a measurement of the colour of the filling liquid, as well as other controls determined based on the specific application requirements. Sampling control stations currently known therefore comprise one or more of the respective measurement modules.

In order to carry out the sampling control the containers are generally picked up at predetermined intervals.

At present such picking up of the treated containers to subject them to sampling control mainly takes place manually in order to transfer them to the single measurement modules.

However, sampling control stations provided with automated pick-up means are also known.

Such known pick-up means pick up the container laterally at the middle of the bottle body, preferably at the height of the barycentre of the container or, if present, at an annular recess of the body thereof.

Therefore, it is necessary to set the gripping means each time to suit the dimensions (height and diameter) of the particular container to be picked up.

Such control stations currently known comprise a plurality of measuring modules at which the pick-up means transport a hooked bottle or container in an automated manner.

In particular, control stations currently known comprise a module for measuring the removal torque and/or the reclosing angle that acts on a bottle or container when it is taken into a measuring zone by the pick-up means.

The module for measuring the removal torque and the reclosing angle present in known sampling control stations grips from below and, acting upon the bottom portion of the container, unscrews it by a certain angle measuring the torque necessary to carry out such unscrewing and, then, screws it back up again acting upon the bottom portion of the container. During its measurement, the cap is locked so as to prevent it from rotating.

Disadvantageously, the measurement provided by the module for measuring the removal torque and the reclosing angle currently known does not have a high degree of precision in particular due to the adding up of the tolerance measurements introduced by the torsion of the bottle or of the container. The measurements are indeed influenced by the height of the container, by the material and by the shape in which it is made and so on.

Moreover, the coupling with the bottom of the bottle is subject to a suitable setting each time the dimensions of the bottle or container treated by the filling line change.

The purpose of the present invention is to avoid the aforementioned drawbacks and in particular so devise a sampling control station for bottles or containers filling plants that can carry out the measurement of the removal torque and the reclosing angle fully automatically irrespective of the dimensions of the bottle or container treated.

Another purpose of the present invention is to provide a sampling control station for containers or bottles filling plants that ensures a reliable measurement of the removal torque and the reclosing angle irrespective of the characteristics of the particular container treated.

A further purpose of the present invention is to make a containers or bottles filling plant provided with such a sampling control station.

These and other purposes according to the present invention are accomplished by making a sampling control station for a containers or bottles filling plant and by a containers or bottles filling plant comprising the same as outlined in the independent claims.

Further characteristics of the sampling control station and of the filling plant are the object of the dependent claims.

The characteristics and advantages of a sampling control station for a containers or bottles filling plant according to the present invention will become clearer from the following description, given as an example and not for limiting purposes, referring to the attached schematic drawings, in which.

Figure 1:
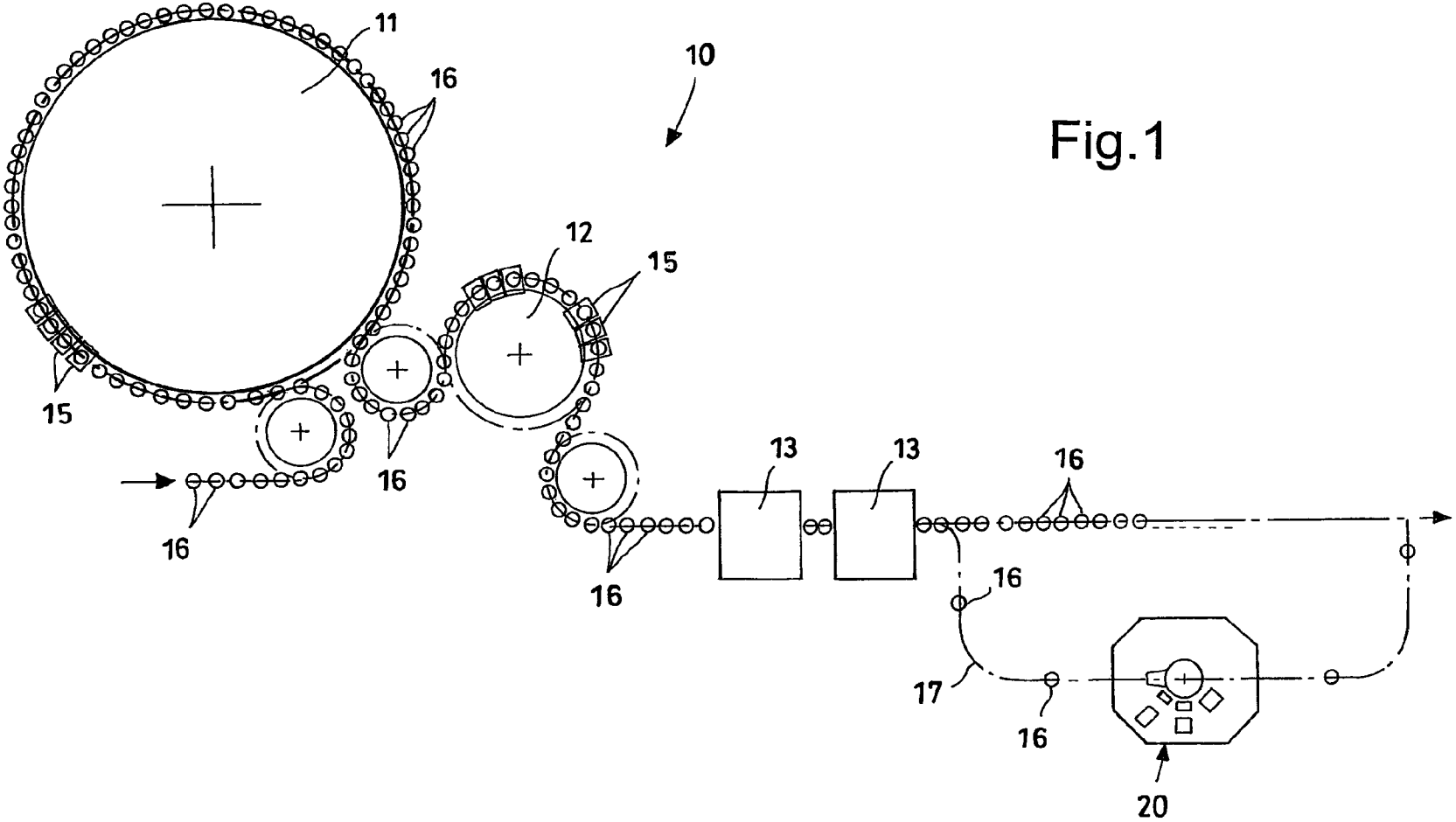
FIG. 1 is a schematic plan view of a preferred embodiment of the containers or bottles filling plant according to the present invention.
Figure 2:
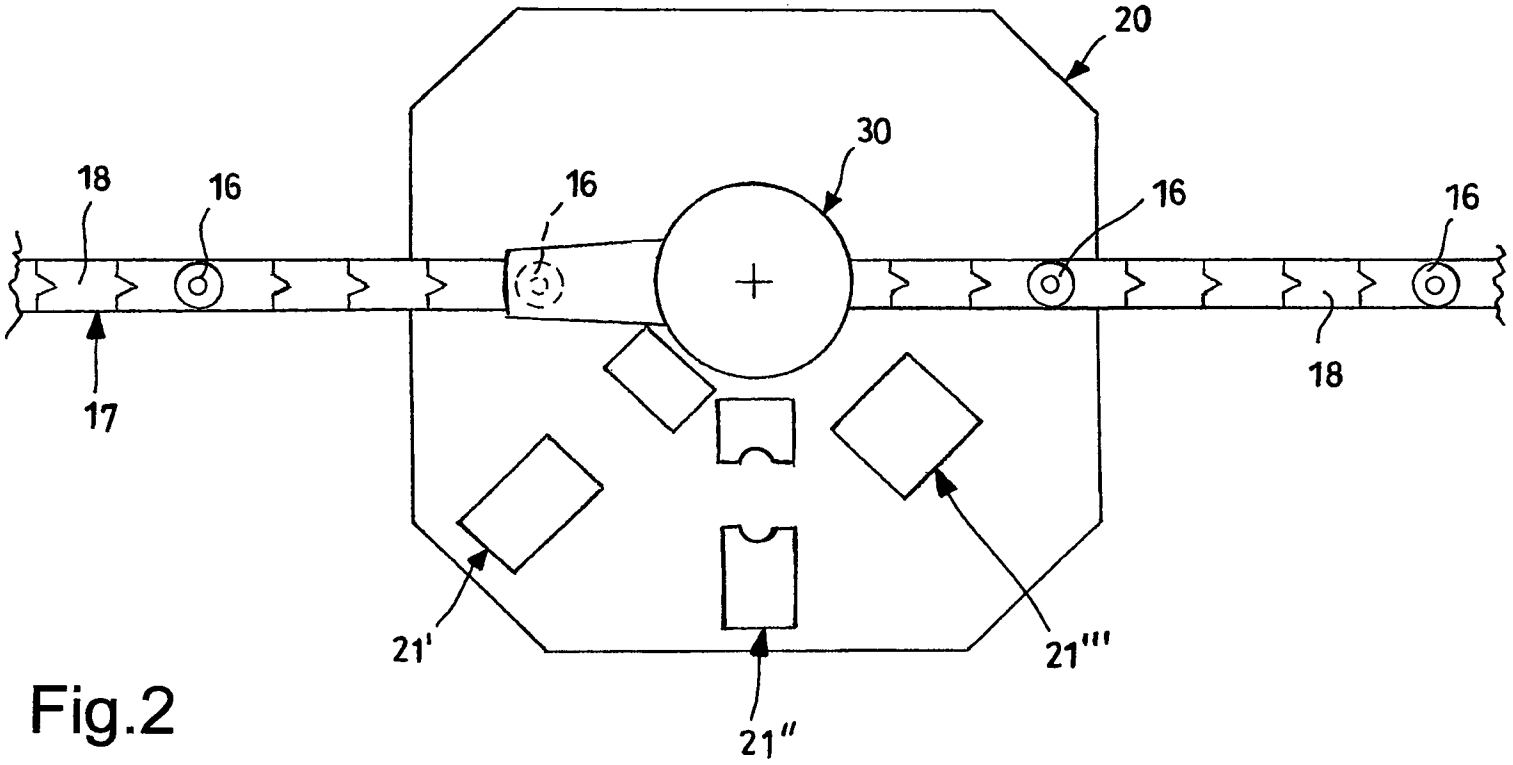
FIG. 2 is a plan view of a preferred embodiment of the sampling control station according to the present invention.
Figure 3:
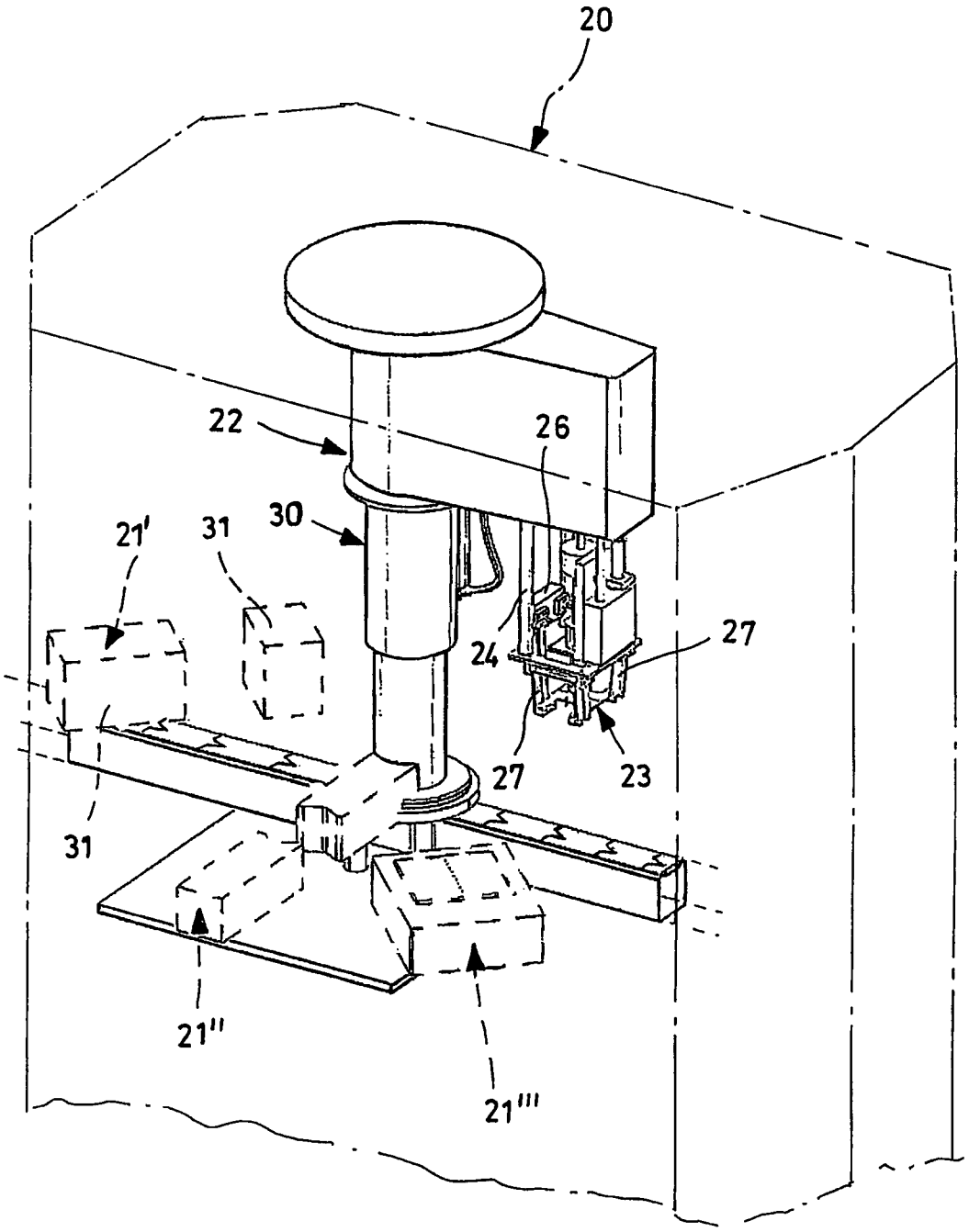
FIG. 3 is a schematic perspective view of the grasping and transporting means of the sampling control station according to the present invention in which three measuring modules are represented in a simplified manner through a broken line.
Figure 4:
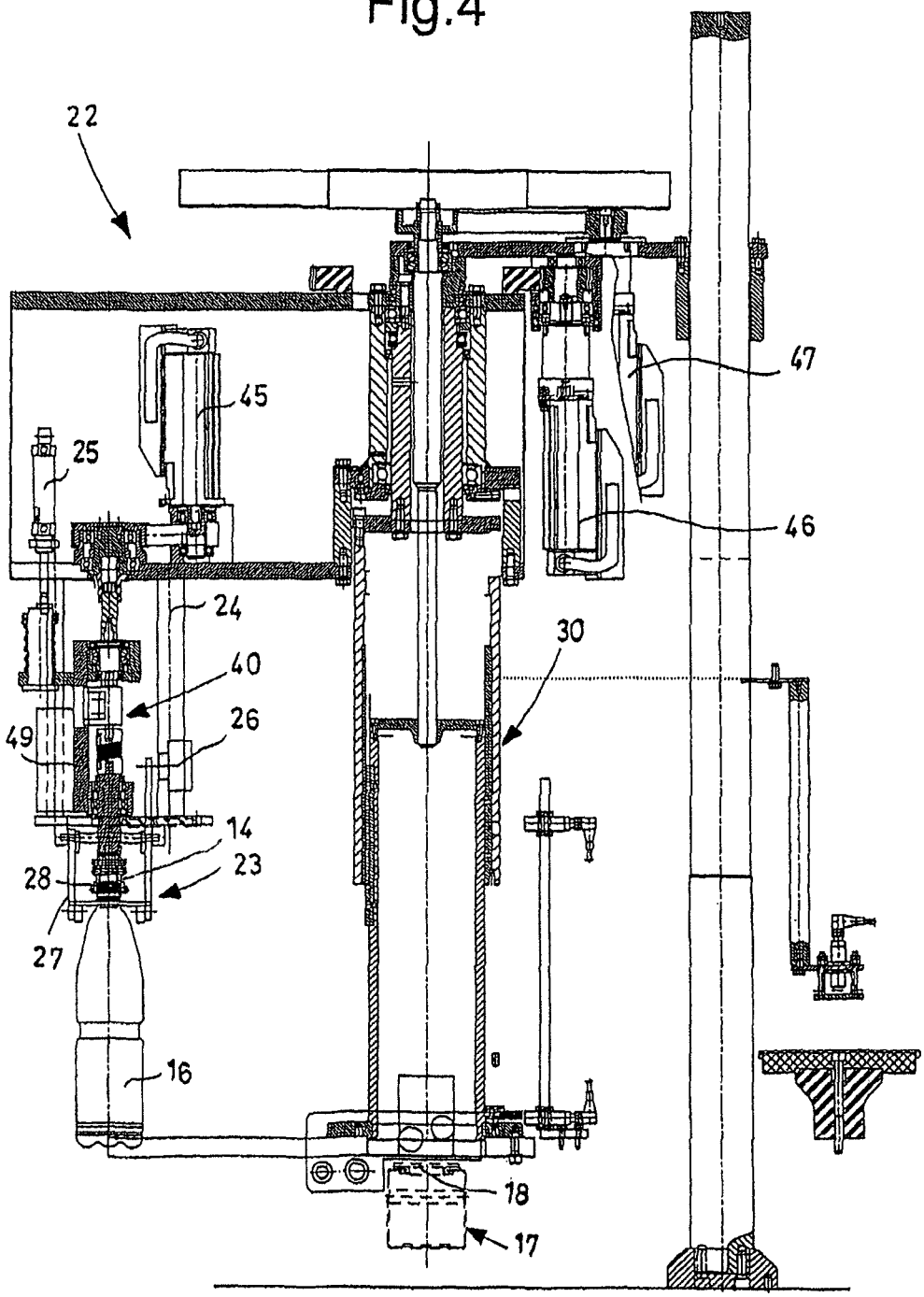
FIG. 4 is a partial section view of the grasping means of FIG. 3.
Figure 5:
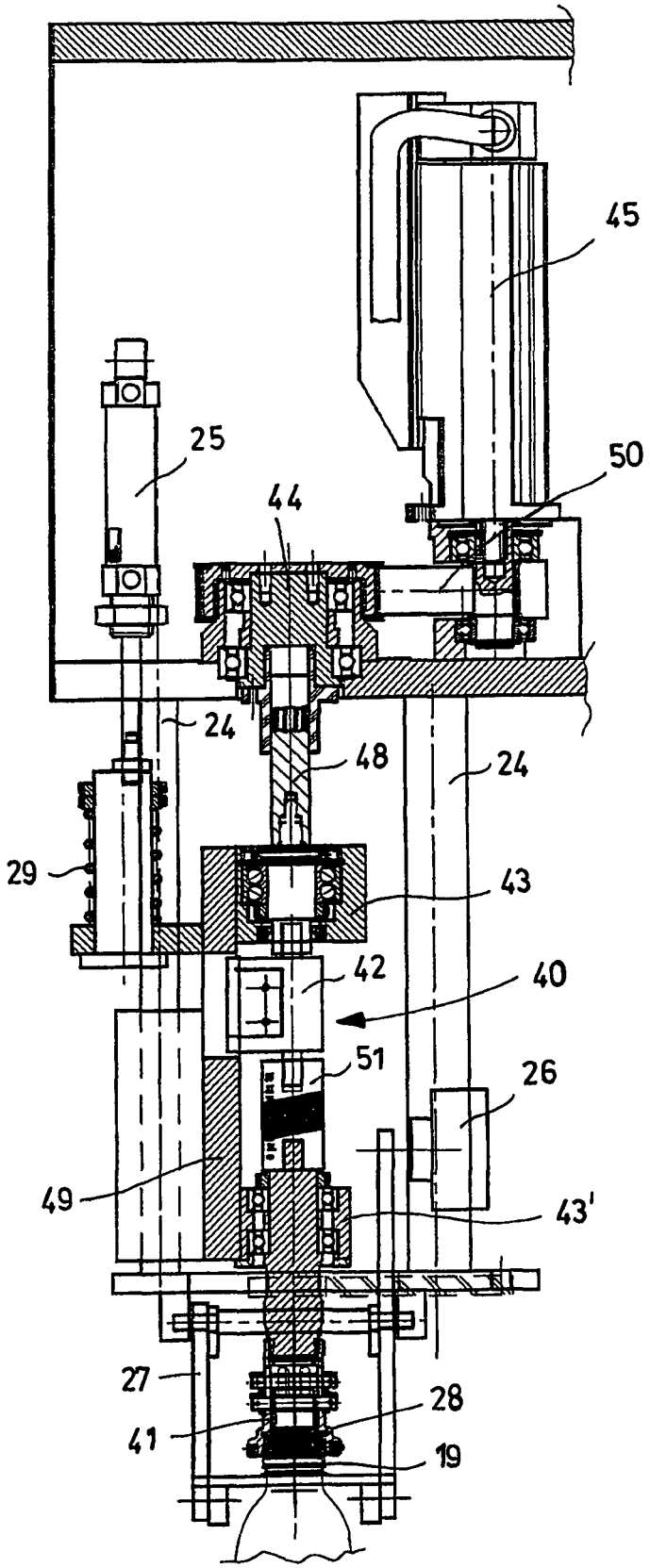
FIG. 5 is an enlarged detail of FIG. 4.

With reference to the figures, a containers or bottles filling plant is shown, wholly indicated with 10.

In a particularly preferable but not exclusive manner, the plant 10 according to the present invention treats containers or bottles having a shape that tapers into a neck ending with a mouth, in which there is an annular ribbing 19, also known as crown or lip, at the neck, near to the mouth.

Such a plant comprises a first station 11 for filling bottles or containers 16, followed by a second station 12 for closing and/or capping the bottles or containers 16.

The filling and closing stations in turn comprise a plurality, respectively, of taps or filling valves 15 and of closing and/or capping heads 14 constrained to move forward along the periphery of the respective first and second station 11,12 so as to follow the bottles being treated for a section, filling and/or capping them in movement.

Preferably, the first 11 and the second 12 station have a circular configuration, in which the taps or filling valves 15 and the closing and/or capping heads 14 are connected to the periphery of a turntable or carousel. Such stations 11,12 can for example be provided respectively with about 80 taps or filling valves 15 and with about 20 closing and/or capping heads 14.

The containers or bottles 16 are transported through special conveying means, like for example a set of conveying means connected and free on a conveyor belt 18, along a path that at least partially follows the periphery of the first 11 and second 12 station.

Downstream of the second station 12 with respect to the direction of forward movement of the container 16 at least one control station 13 is foreseen in addition.

Downstream of the at least one control station 13 there are also advantageously deviator means (not illustrated) which, at predetermined intervals, direct a subset of containers towards a secondary branch 17 along which a sampling control station 20 is arranged.

Preferably, the secondary branch 17 is configured like a by-pass branch so as to be able to reinsert the containers 16 whose characteristics, from the sampling measurements, fall within the required ranges back into the line.

The sampling control station 20 comprises at least one measuring module 40,21',21",21'" through which one or more parameters of a container 16 indicative of the correct operation of the taps or filling valves 15 and/or of the capping heads 14 are verified.

For example, to control the taps or filling valves 15 it is possible to use a module for measuring the fill level or a module for measuring the weight of the container 16.

To control the capping heads 14, on the other hand, it is possible to use a module for measuring the capping height or a module for measuring the reclosing angle and the removal torque of the capsule or cap 28 of the container 16.

In particular, the at least one measuring module 40,21',21", 21'" of the sampling control station 20 object of the present invention comprises at least one module 40 for measuring the removal torque and/or the reclosing angle.

Advantageously, a module for measuring the gas content and/or pressure is also foreseen arranged so as to carry out the measurement immediately after the measurement carried out by the module 40 for measuring the removal torque and the reclosing angle to verify that the container 16 has been correctly closed up during the screwing control step.

Finally, the sampling control station 20 can advantageously also be equipped with a module for measuring the colour made for example through suitable colorimeters.

The module for checking the fill level can be implemented with various technologies, according to the container 16 and the liquid to be checked, the speed and the precision required. Normally a high-frequency module or high-frequency capacitive module, generally used for all food liquids, is used: the bottles pass through a measurement bridge made up of two metal plates that oscillate at high frequency. The plates are suitably connected to an electronic board dedicated to the measurement the variation in frequency or capacity as the bottles pass. The variations are proportional to the amount of liquid. The detected values, suitably filtered and amplified, are processed by a processing unit (not illustrated) in order to evaluate whether to accept or discard the container 16 under analysis.

Alternatively, to make the module for measuring the fill level it is possible to use an X-ray source generally used for all types of containers and liquids.

Such an X-ray source is made up of a generator intended to emit a beam of rays capable of penetrating the passing bottles and striking a reception sensor known as scintillator. According to the amount of rays striking the receiver, a processing unit (not illustrated) is able to evaluate whether to accept or discard the container 16 under analysis.

In order to check the fill level it is also possible to use industrial video cameras. The video camera correlated to a suitable lighting system, takes a photograph of all the samples under analysis and suitable software means for processing images calculate the fill level determining whether to accept or discard the container 16.

The module for measuring the weight preferably comprises a metrically approved balance in order to provide an exact measurement of the weight of the filled container 16, also able so be used for certification purposes.

The module for measuring the capping height preferably comprises industrial video cameras correlated to a suitable lighting system that take one or more photographs of the containers under analysis. From electronic processing of the images the capping height can be determined and it can be decided whether to discard or accept the container 16.

Finally, the module for measuring the gas content and/or pressure can for example be implemented through a pressure transducer made using different technologies such as linear or proximity transducers, load cells, lasers, and so on. Whether to accept or discard the container 16 is determined based on suitable processing of the values detected by the transducer.

The module 40 for measuring the removal torque and/or the reclosing angle of the cap 28 is carried out so as to act upon a container 16 arranged at a measuring zone into which the containers are transported, after having been picked up by the conveying means 18 through a grasping and transporting group 22.

According to the present invention, the module 40 for measuring the removal torque and/or the reclosing angle of the cap 28 is mobile between a coupling position, in which it is engaged with the cap 28 of the container 16 and can set is in rotation, and a release position in which it is not engaged with the container 16.

In particular, the module 40 for measuring the removal torque and/or the reclosing angle is arranged above the measuring zone.

According to the illustrated preferred embodiment, the module 40 for measuring the removal torque and/or the reclosing angle of the cap 28 preferably comprises a first part able to translate vertically and a second part fixed in translation.

The first translatable part 41,43,43',49,48 of the measuring module 40 comprises coupling means 41 with the cap 28 facing the measuring zone, in which such means 41 are mobile between a first position engaged with the cap 28 and a second position disengaged from the cap 28.

The means 41 for coupling with a cap can for example be made through a positive coupling cone 41 having a flared coupling portion or else by a pincer (not illustrated) able to be adapted to the diameter of the cap 28, like a pincer provided with spring-loaded jaws that clamp onto the surface of the cap 28.

The means 41 for coupling with the cap 28 are connected on top to a slide 49 through two bearing blocks 43,43' mounted on a vertical shaft 48, that allow the relative rotation between such coupling means 41 and the slide 49.

The slide 49 is in turn connected to a support guide 24 and is set in vertical translation along the guide 24 by a first actuator 25.

The first actuator 25 preferably has elastic means 29 coupled with it that compress once the coupling means 41 reach the cap 28 of the container 16, thus limiting the thrusting action transferred by the first actuator 25.

On top of the means 41 for coupling with the cap 28 a torsion sensor 42 is also arranged, like for example a torque meter, to measure the torque necessary to start unscrewing the cap 28. Preferably, the torsion sensor 42 is arranged between the two bearing blocks 43,43'.

Preferably, the vertical shaft 48 is interrupted by an elastic joint 51 suitable for decoupling the torsion sensor 42. Such an elastic joint 51 can be positioned above or below such a torsion sensor 42.

The second part fixed in translation of the module 40 for measuring the removal torque and the reclosing angle of the cap 28 comprises a hub 44 in which the vertical shaft 48 connected to the first translatable part 41,43,43',49,48 is free to slide along the vertical axis.

The hub 44 is set in rotation through a second actuator 45, preferably a brushless motor, through a belt transmission 50, and in turn transfers a rotation torque to the vertical shaft 48 of the first translatable part that for this purpose has grooves (not illustrated) that go into coupling with the rotary part of the hub 44.

The second actuator 45 comprises, fitted directly onto the drive shaft, an encoder (not illustrated) for measuring the rotation angle of the vertical shaft 48 when the cap 28 is made to close.

The grasping and transporting group 22 of the sampling station 20 comprises gripping means 23 connected to a mobile support structure 30.

The gripping means 23 are mobile between a gripping position, in which they are engaged with the body of the container 16, and a release position.

According to a preferred embodiment, the gripping means 23 take grip below the ribbing 19 present at the neck of the container body.

Even more preferably, the gripping means 23 take grip from above, defining a gripping mouth having a vertical gripping axis in their open configuration.

Otherwise, the gripping can also take place at the middle of the container body with vertical or horizontal gripping axis.

The connection of the gripping means 23 to the mobile support structure 30 makes it possible to pick up the container 16 from the conveying means (conveyor belt) 18, moving it forward along the measuring zone also to other measuring modules 21',21",21'" to then bring it back again onto the conveyor belt 18 once the measurement has been carried out and no anomaly has been found.

Preferably, the support structure 30 is of the rotary type with centre of rotation arranged at a position of the conveyor belt 18, and the further measuring modules 21',21",21'" are arranged along the circumference described by the movement of the gripping means 23 when moved by the mobile support structure 30.

For this purpose, the mobile support structure 30 is set in rotation through a third actuator 46. In addition, the mobile support structure 30 is set in vertical translation through a fourth actuator 47 in order to carry out an initial adjustment of the suspension height of the gripping means 23, dependent upon the particular container to be treated 16.

Both the third 46 and fourth 47 actuators are preferably of the brushless type.

In the illustrated embodiment, the gripping means 23 are made as a pincer and can be actuated through movement means 26,27 that preferably comprise a fifth actuator 26 that acts upon a lever mechanism 27 to open and close them 23.

Once a container 16 has been hooked through the grasping and transporting group 22, such a grasping and transporting group 22 is perfectly aligned with the cap 28 of the container 16.

Moreover, since the distance between the cap and the ribbing 19 at which the engagement of the gripping means 23 takes place, substantially the same for the majority of types of containers 16, the position of the cap 28 is also well known and constant.

In order to better exploit such aligned positioning, according to a preferred aspect of the present invention, the module 40 for measuring the removal torque and/or the reclosing angle of the cap 28 of the container 16 is connected to the grasping and transporting group 22.

In this case, the module 40 for measuring the removal torque and the reclosing angle is also mobile along the measuring zone described by the movement of the gripping means 23 therefore being able to carry out a measurement substantially in any position of such a zone.

Once the gripping means 23 are engaged with the body of a container 16 they are able to give the body thereof a reaction torque of sufficient strength to unscrew and subsequently close back up the cap 28.

In such a gripping configuration the module 40 for measuring the removal torque and/or the reclosing angle of the cap 28 is lowered from an elevated position along the guide 24 until it comes into contact with the cap 28 of the container 16.

In such a configuration the simultaneous measurement of the removal torque and of the reclosing angle given to the capping and/or closing heads 14 of the second station 12 takes place.

The operation of the sampling control station 20 for a bottles or containers filling plant 10 is the following.

Every predetermined time period, the deviator means arranged along the filling line divert a container 16 towards the secondary branch 17 along which the sampling control station 20 is arranged.

The diverted container 16 moves forward towards the sampling control station 20 and, once reached, it is picked up by the grasping and transporting group 22 and transported into a measuring zone at at least one measuring module 40,21',21", 21'".

For this purpose, the gripping means 23 of the grasping and transporting group 22 are initially positioned, through the movement of the mobile support structure 30, at a pick-up point of the container 16 along the conveying line 18, and once the container 16 is present, they are brought close to the container 16 and actuated so as to go into engagement with it.

In particular, in the preferred embodiment illustrated, the gripping means 23 are brought close to the neck of the container and positioned so as to go into engagement with the annular ribbing 19 present on the neck of the container body 16, at the mouth thereof.

Once the container 16 has been gripped, the gripping means 23 are translated upwards again through the movement of the mobile support structure 30.

The mobile support station 30 transports the set consisting or the gripping means 23 and the container to a first measuring module 21' where a first analysis takes place.

The container 16 is then moved to a second measuring module 21" and so on for every measuring module present in the sampling control station 20.

Once the container 16 has been transported to the measuring zone of the module 10 for measuring the removal torque and/or the reclosing angle of the cap 28 of the container 16, such a module 40 is taken into coupling with the cap 28 of the container 16 so as to be able to carry out the measurements.

If the module 40 for measuring the removal torque and/or the reclosing angle of the cap 28 of the container 16 is connected to the grasping and transporting group 22 like in the illustrated preferred embodiment, such a module 40 is able to carry out a measurement at any position of the measuring zone in which the container 16 is transported.

For the measurement of the removal torque and the reclosing angle of the cap 28 the gripping means 23 lock the body of the container 16 against a rotation, i.e. they apply the reaction torque necessary to unscrew and subsequently close back up the cap 28.

It is therefore possible for the module 40 for measuring the removal torque and/or the reclosing angle of the cap 28 to apply a torque sufficient to start unscrewing the cap, at the same time measuring the strength of the torque necessary for such unscrewing, and then take care of screwing back up the unscrewed cap with a predetermined torque value, measuring the angle necessary to clamp it back up again.

The control module 21',21",21'" after the removal torque and the reclosing angle control is preferably a gas content and/or pressure control in order to verify that the previous control of the removal torque and of the reclosing angle has not modified the gas content parameters possibly measured in the line by one of the third control stations 13.

Once all of the measurements have been made and in the case in which no anomalies are found, the mobile support structure 30 positions the gripping means 23 at a release point of the container.

Preferably, if the secondary branch 17 is configured like a by-pass branch, the release point of the container is arranged on the conveyor belt 18 downstream of the sampling control station 20 so as to be able to be automatically taken away and inserted back in the line.

Otherwise, in the case in which anomalies are found, the mobile support structure 30 positions the gripping means 23 at a discarding container (not illustrated) where the defective container 16 is released through the opening of the gripping means 23.

From the description that has been made the characteristics of the sampling control station for bottles or containers filling plants object of the present invention are clear, just as the relative advantages are also clear.

Indeed, the sampling control station is able to carry out a measurement of the removal torque and of the reclosing angle of the cap substantially independently from the dimensions of the particular container measured, since the relative measuring module couples directly with the cap of the container whose dimensions, as known, do not have a high degree of variability. Moreover, given that the module for measuring the removal torque and the reclosing angle acts directly on the cap, whereas the container is kept still with respect to a rotation, the measurements are influenced much less by the particular characteristics of the container with respect to the solution offered by the state of the art in which it is the container that is rotated while the cap is prevented from rotating.

Last but not least, if the module for measuring the removal torque and the reclosing angle is connected to the grasping and transporting group, the measurement can take place in any point of the measuring zone described by the displacement of the gripping means.

Finally, the sampling control stations according to the present invention can house a plurality of measurement modules in small spaces thanks to the particular arrangement thereof along the circumference described by the movement of the gripping means. Moreover, by optionally foreseeing many grasping and transporting groups it possible to manage many measurement modules simultaneously, therefore increasing the capacity of the station.

Finally, it is clear that the sampling control station for bottles or containers filling plants thus conceived can undergo numerous modifications and variants, all of which are covered by the invention; moreover, all of the details can be replaced by technically equivalent elements. In practice, the materials used, as well as the sizes, can be whatever according to the technical requirements.

The invention claimed is:

1. Sampling control station (20) for a containers or bottles filling plant comprising at least one grasping and transporting group (22) for picking up containers or bottles (16) from conveying means (18) and transporting said containers and bottles so that they may be measured by a module (40) for measuring the removal torque and/or the reclosing angle of a cap (28) of a container (16) acting upon a container or bottle (16) wherein said grasping and transporting group (22) comprises a mobile support structure (30) which is a rotary support structure having a centre of rotation positioned above said conveying means (18), and in that said rotary support structure (30) comprises at least one further measuring module (21', 21", 21"), said at least one further measuring module (21', 21", 21'") being arranged along a circumference traversed by said gripping means (23) by the movement of said rotary support structure (30), said containers or bottles (16) being provided with a body tapered into a neck and ending with a mouth, said mouth being clamped through said cap (28), characterised in that said module (40) for measuring the removal torque and/or the reclosing angle is such as to take up a first configuration engaged with said cap (28), in which said cap (28) can be set in rotation by said module (40) for measuring the removal torque and the reclosing angle, and a second configuration disengaged from said cap (28).

2. Sampling control station (20) for a containers or bottles filling plant according to claim 1 characterised in that said measuring module (40) is positioned above said measuring zone.

3. Sampling control station (20) for a containers or bottles filling plant according to claim 1 characterised in that said grasping and transporting group (22) comprises a mobile support structure (30) to which gripping means (23) are connected that are suitable for applying a reaction torque to said body of said container (16) that is of sufficient strength to allow to unscrew said cap (28).

4. Sampling control station (20) for a containers or bottles filling plant according to claim 1 characterised in that said measuring module (40) comprises means (41) for coupling with said cap (28) arranged facing said measuring zone and mobile between a first position engaged with said cap (28) and a second position disengaged with said cap (28), said coupling means (41) being set in rotation so as to transfer a rotation torque to said cap.

5. Sampling control station (20) for a containers or bottles filling plant according to claim 4 characterised in that, said coupling means (41) are able to translate vertically and a torsion sensor (42) is arranged above them said coupling means (41) to measure the torque needed to begin unscrewing said cap (28).

6. Sampling control station (20) for containers and bottles filling plant according to claim 5 characterised in that said coupling means (41) are connected on top to a slide (49) that can translate vertically through two bearing blocks (43, 43') mounted on a vertical shaft (48) that allow the relative rotation between said coupling means (41) and said slide (49).

7. Sampling control station (20) for a containers or bottles filling plant according to claim 4 characterised in that said coupling means (41) are a positive coupling cone (41) comprising a flared portion for coupling with said cap (28).

8. Sampling control station (20) for a containers or bottles filling plant according to claim 1 characterised in that said module (40) for measuring the removal torque and/or the reclosing angle is connected to said grasping and transporting group (22).

9. Sampling control station (20) for a containers or bottles filling plant according to claim 1 characterised in that said measuring module (40) comprises a hub (44) in which said vertical shaft (48) is free to slide vertically, said shaft (48) being connected to said hub (44) so that they cannot rotate one with respect to the other, said hub (44) being set in rotation and transferring a rotation torque to said vertical shaft (48).

10. Sampling control station (20) for a containers or bottles filling plant according to claim 1 characterised in that at said neck of said container body (16) there is an annular ribbing (19), said gripping means (23) being mobile between a gripping position, in which they are engaged with said neck of said container (16) at said annular ribbing (19), and a release position in which they are not engaged with said container (16).

11. Sampling control station (20) for a containers or bottles filling plant according to claim 10 characterised in that said gripping means (23) define a gripping mouth having a vertical axis.

12. Sampling control station (20) for a containers or bottles filling plant according to claim 10 characterised in that said gripping means (23) are made as a pincer and are opened and closed through a lever mechanism (27).

13. Plant (10) for filling containers or bottles comprising conveying means (18) on which a plurality of bottles or containers (16) is moved along a direction of forward movement, with there being, arranged in succession along said direction of forward movement, a first station (11) for filling said bottles or containers (16), a second station (12) for closing and/or capping said bottles or containers (16) and at least one third station (13) for controlling at least one filling parameter, characterised in that downstream of said at least one third control station (13) said bottles or containers (16) are directed towards a secondary branch (17) along which there is at least one sampling control-station (20) according to claim 1.

* * * * *